United States Patent [19]

Thornton

[11] Patent Number: 4,949,971

[45] Date of Patent: Aug. 21, 1990

[54] GOLF TRAINING AID

[76] Inventor: C. J. Thornton, 4452 S. Rogers La., Claremore, Okla. 74017

[21] Appl. No.: 393,648

[22] Filed: Aug. 14, 1989

[51] Int. Cl.[5] ..... A63B 69/36

[52] U.S. Cl. ..... 273/186 A; 273/163 A

[58] Field of Search ..... 273/163 R, 163 A, 194 R, 273/183 D, 186 A, 186 B, 186 C, 193 R, 193 B, 194 A, 162 F, 162 R

[56] References Cited

U.S. PATENT DOCUMENTS 3,118,678 1/1964 Rohr ..... 273/163 A
3,253,829 5/1966 Ford ..... 273/194
3,273,893 9/1966 Duncan ..... 273/163 A
3,298,693 1/1967 Eisenberg ..... 273/194 R

*Primary Examiner*—George J. Mario
*Attorney, Agent, or Firm*—Richard C. Litman

[57] ABSTRACT

An improved golf training aid is provided having a rotatable T-shaped pointer mounted to a block. The block has two sections that are fastened together by screws. The screws tighten or loosen the grip on the golf club shaft. The T-shaped pointer is mounted in another slit passageway, one leg acting as the axis of rotation. Screws also act to hold the pointer in place. When not in use, the pointer can be rotated up for easy storage.

3 Claims, 1 Drawing Sheet

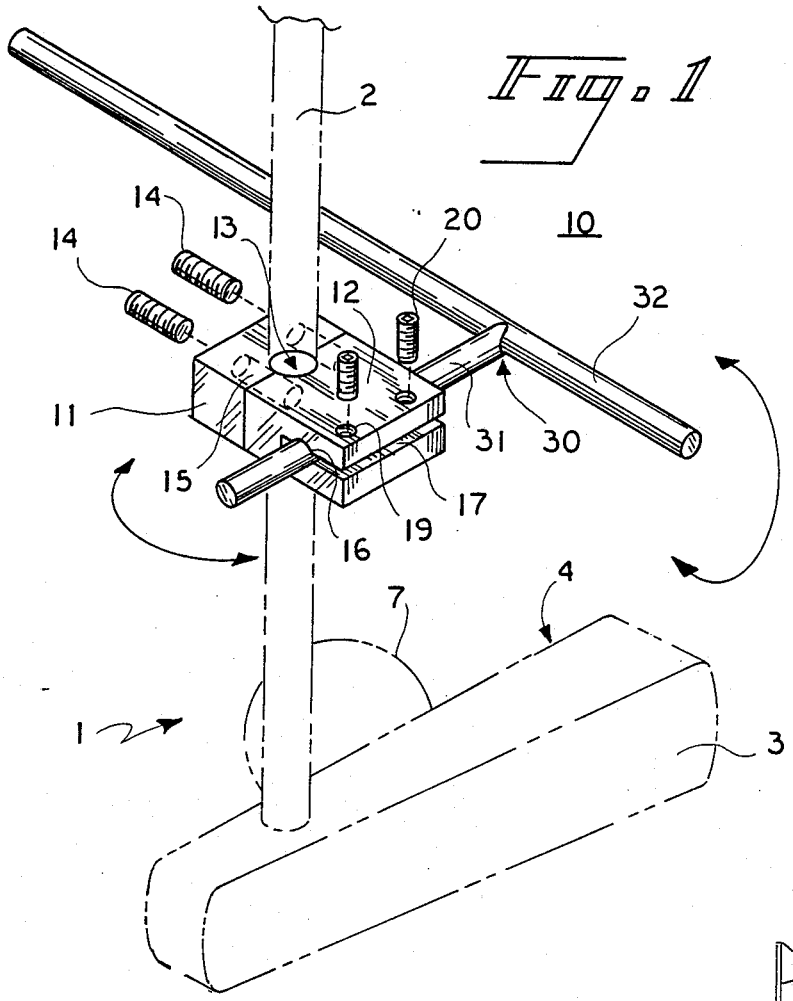
Fig. 1
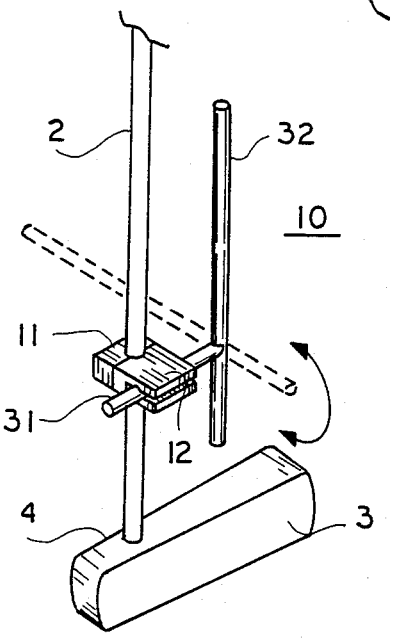
Fig. 3
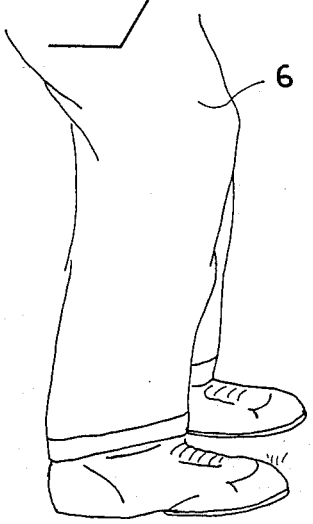
Fig. 2
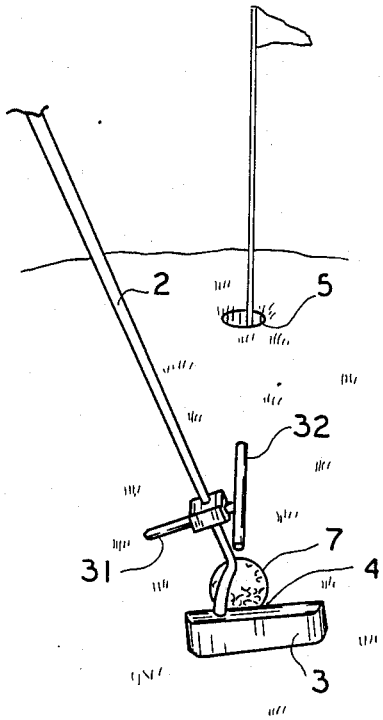

GOLF TRAINING AID

BACKGROUND OF THE INVENTION

1. Field of the Invention

The present invention relates to golfer's aids designed to improve the accuracy of a golfer's swing. More specifically, it relates to sighting devices that may be mounted on the shaft of a golf club to show the direction of the hole.

2. Description of the Prior Art

Numerous devices are known to assist a golfer in lining up his swing in relations to the hole. The following patents are felt to be related to the present invention, but do not disclose, whether singly or in combination, the applicant's unique invention.

U.S. Pat. No. 3,253,829 issued to Ford discloses a golf club provided with a sighting means in the form of an elongated body mounted on the shaft and oriented parallel to the sole plane of the club head to point in the direction of the strike.

U.S. Pat. No. 3,298,693 issued to Eisenberg discloses a direction indicator for golf clubs comprising an arrow pivotably secured to the club shaft and pointing in the direction of the stroke.

One disadvantage of these prior art devices is the inability to readily store the directional device on the club. The pointers tend to take up space because they are oriented in a direction normal to the shaft of the club. Applicant's device allows for easy storage of the putter with the attached directional pointer.

SUMMARY OF THE INVENTION

The present invention of a golf training aid comprises a two piece body block that encircles the shaft of a golf club. The two pieces are held and tightened together by screws. The shaft of the club goes through a passageway formed between the two body pieces.

At one end of the block assembly is another passageway, normal to the first passageway, that grips the direction pointer. This passageway can also be tightened by screws. The direction pointer consists of a T-shaped bar. One leg of this T-shaped bar is gripped by the block and the other end acts as the actual direction pointer.

The device as a whole can be adjusted up and down the length of the club shaft. The T-shaped pointer can be rotated so as to be parallel with the club shaft, thereby allowing easy storage.

Accordingly, it is one object of the present invention to provide a golf training aid that can provide proper positioning of a golf club in relation to a hole.

It is another object of the present invention to provide a golf training aid having a direction pointer that can be moved relative to a block that grips the club shaft.

It is a further object of the present invention to provide a golf training aid with a direction pointer pointer that can be rotated relative to a holding block and the golf club shaft.

It is a yet further object of the present invention to provide a golf training aid that can be easily stored without removing it from the club shaft.

These and other objects of the present invention will become readily apparent upon further review of the following specification and attached drawings.

BRIEF DESCRIPTION OF THE DRAWINGS

FIG. 1 shows an exploded view in perspective of the golf training aid.

FIG. 2 shows a view of the golf training aid in use.

FIG. 3 shows a perspective view of the golf training aid with the pointer rotated parallel to the club shaft.

Similar reference characters denote corresponding features consistently throughout the attached drawings.

A DETAILED DESCRIPTION OF THE PREFERRED EMBODIMENT

The components of the golf training aid 10 are shown in FIG. 1. The main body block assembly consists of block sections 11,12. Passageway 13 is provided for gripping of a golf club shaft 2. Sections 11,12 form both halves of passageway 13. The block sections 11,12 are held together by Allen head screws 14,14. Passageways 15,15 that pass through both blocks 11,12 provide the appropriate threaded communication means for screws 14,14. By loosening or tightening the screws 14,14, the grip of the training aid 10 on the club shaft 2 can be loosened or tightened. This allows the golf training aid 10 to be positioned anywhere along the length of the club shaft 2.

Another passageway 16 traverses through the end of block 12. A slit 17 runs from the length of passageway 16 to the end 18 of block 12. Disposed through block 12 are additional passageways 19,19 for screws 20,20. These screws 20,20 are used to tighten or loosen the grip passageway 16 has on the T-shaped pointer 30 by reducing the clearance between the sides of the slit 17. The pointer's 30 position relative to the blocks 11,12 can be adjusted by using these tightening screws 20,20.

Pointer 30 comprises two sections, bars 31,32, which are formed into a T-shape. Bar 31 is gripped by the passageway 16 in block 12. Bar 32 is the actual pointer or direction indicator. The bar 32 runs parallel with the side of the block assembly 11,12. In the initial positioning of the golf club aid 10 along the shaft 2 of the club 1 the pointer sight 32 is positioned so that it runs perpendicular to the face 4 of the club head 3. The club 1 would usually be a putter in most cases. The user would line up a hole 5 so that it is in a straight line relationship with the pointer 32 such as shown in FIG. 2. This can be done by sighting down the length of the pointer sight 32. Once the club 1 is in position, the player 6 can place his feet and body about the club 1.

The pointer 30 can be rotatably and axially adjusted in relation to passageway 16 so that the length of the pointer sight 32 is positioned over the club head 3 and is directly over the point on the face 4 at which it is desirable to contact the ball 7 such as is shown in FIG. 2. This allows the player to have a visual guide for his backswing and followthrough, by keeping the pointer sight 32 constantly over the ball 7.

While the club 1 is not in use it can be easily stored in a bag with the other clubs. The pointer 30 can be rotated as shown in FIG. 3 so that the sight 32 is parallel with the club shaft 2. This significantly reduces the space necessary to store the club 1 with the attached golf training aid 10.

The device 10 can be manufactured from a variety of materials, preferably metals such as steel or aluminum. The pointer 30 would be formed in one piece as would block sections 11,12.

It is to be understood that the present invention is not limited to the sole embodiment described above, but encompasses any and all embodiments within the scope of the following claims.

I claim:

1. An improved golf training aid including:

a first block section;

a second block section;

said first and second block sections removably affixed together;

a first passageway disposed through said block sections and adapted for passage of a golf club shaft, said first passageway being formed by said block sections and axially divided when said block sections are disengaged;

an elongated pointer bar rotatably attached to said second block section, said elongated pointer bar being rotatable about an axis normal to said pointer bar, said elongated pointer bar being rotatably attached to said second block section by a smooth surfaced elongated pointer shaft normally affixed to said elongated pointer bar and disposed through a smooth surfaced second passageway in said second block section which is non-intersecting with said first passageway, said elongated pointer shaft being axially displaceable and rotatable within said second passageway;

said second passageway being disposed normally in relation to said first passageway;

said second passageway having a continuous lengthwise opening to the surface of said second block section in the form of a planar slit; and threaded fastener means disposed normally through said planar slit to adjust said second passageway clearance around said elongated pointer shaft.

2. The improved golf training aid according to claim 1, wherein:

said first and second block sections are removably affixed by threaded fastener means;

said threaded fastener means also acting as a tightening means to compress said first and second block sections about said golf club shaft disposed in said first passageway.

3. The improved golf training aid according to claim 1, wherein:

said first and second block sections affixed together form a rectangular block;

said elongated pointer bar is disposed parallel to a face of said rectangular block.

* * * * *